US010994559B2

(12) United States Patent
de Ceano et al.

(10) Patent No.: US 10,994,559 B2
(45) Date of Patent: May 4, 2021

(54) TRANSPORTING A MEDIUM

(71) Applicant: HEWLETT-PACKARD DEVELOPMENT COMPANY, L.P., Spring, TX (US)

(72) Inventors: Antonella de Ceano, Sant Cugat del Valles (ES); Pablo Arteaga, Sant Cugat del Valles (ES); Martin Urrutia, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/492,629

(22) PCT Filed: Dec. 18, 2017

(86) PCT No.: PCT/US2017/067073
§ 371 (c)(1),
(2) Date: Sep. 10, 2019

(87) PCT Pub. No.: WO2019/125378
PCT Pub. Date: Jun. 27, 2019

(65) Prior Publication Data

US 2020/0307261 A1 Oct. 1, 2020

(51) Int. Cl.
*B41J 11/00* (2006.01)
*B65H 5/22* (2006.01)

(52) U.S. Cl.
CPC ..... *B41J 11/0085* (2013.01); *B65H 5/222* (2013.01)

(58) Field of Classification Search
CPC ..... B41J 11/0085; B65H 5/222
See application file for complete search history.

(56) References Cited

U.S. PATENT DOCUMENTS 3,223,443 A * 12/1965 Misson ..... B65G 49/061 294/65
6,254,090 B1 7/2001 Rhodes et al.
6,270,074 B1 8/2001 Rasmussen et al.
6,416,176 B1 7/2002 Yasui et al.
6,582,072 B1 6/2003 Wotton et al.
(Continued)

FOREIGN PATENT DOCUMENTS

EP 2098374 1/2013
WO WO2017012637 1/2017
WO WO-2017028900 2/2017

OTHER PUBLICATIONS

Loading Sheets in the Printer, 2009, http://ugp01.c-ij.com/ij/webmanual/Manual/All/PRO-4000/EN/LBGA/tp000058.html.

*Primary Examiner* — Sharon Polk
(74) *Attorney, Agent, or Firm* — HP Inc. Patent Department

(57) ABSTRACT

A system to transport a medium comprises a medium carrier, a negative pressure device, a vacuum chamber and a flow control device. The medium carrier is to carry the medium on a first side. The negative pressure device is to generate a negative pressure that is below an ambient pressure. The vacuum chamber is disposed on a second side of the medium carrier opposite to the first side and fluidly coupled to the negative pressure device. The flow control device is to manipulate a fluid flow from the vacuum chamber towards the negative pressure device. The flow control device is operated in response to the medium carrier changing its operational state.

12 Claims, 9 Drawing Sheets

(56) References Cited

U.S. PATENT DOCUMENTS

| | | | | |
|---|---|---|---|---|
| 6,640,708 | B2 | 11/2003 | Perez et al. | |
| 8,066,283 | B2 | 11/2011 | Yamada | |
| 8,452,195 | B2 | 5/2013 | Rossell et al. | |
| 8,573,729 | B2 | 11/2013 | Takamoto | |
| 8,858,104 | B2 | 10/2014 | Sanekata et al. | |
| 2003/0079631 | A1 | 5/2003 | Claramunt et al. | |
| 2012/0093557 | A1* | 4/2012 | Sanekata | B41J 11/42 400/582 |
| 2014/0160213 | A1 | 6/2014 | Atwood et al. | |
| 2018/0237242 | A1* | 8/2018 | Arredondo Rosales | B41J 11/001 |
| 2019/0308426 | A1* | 10/2019 | Maya Agudo | B41J 11/001 |

* cited by examiner

TRANSPORTING A MEDIUM

BACKGROUND

Some processing procedures carry a medium through a processing area. For example, the processed medium is provided in the form of sheets or supplied in a continuous manner and undergoes the processing while passing through the processing area. For this purpose, the transport of the processed medium may be repeatedly stopped for processing.

A carrier device may be employed for the transport of the processed medium. A suction force may support the adhesion of the medium to the carrier device. The suction force can be generated by applying a negative pressure.

DESCRIPTION OF THE EXAMPLES

In the following, examples of a system and a method are described that may allow for rapidly switching between different levels of suction force applied to a medium to pull the medium towards a medium carrier. The change of the suction force can be related to a change of the operational state of the medium carrier. As a result, the suction force may be varied in response to the operational state of the system. This may open a new possibility for the optimization of the transport of the medium.

Figure 1A:
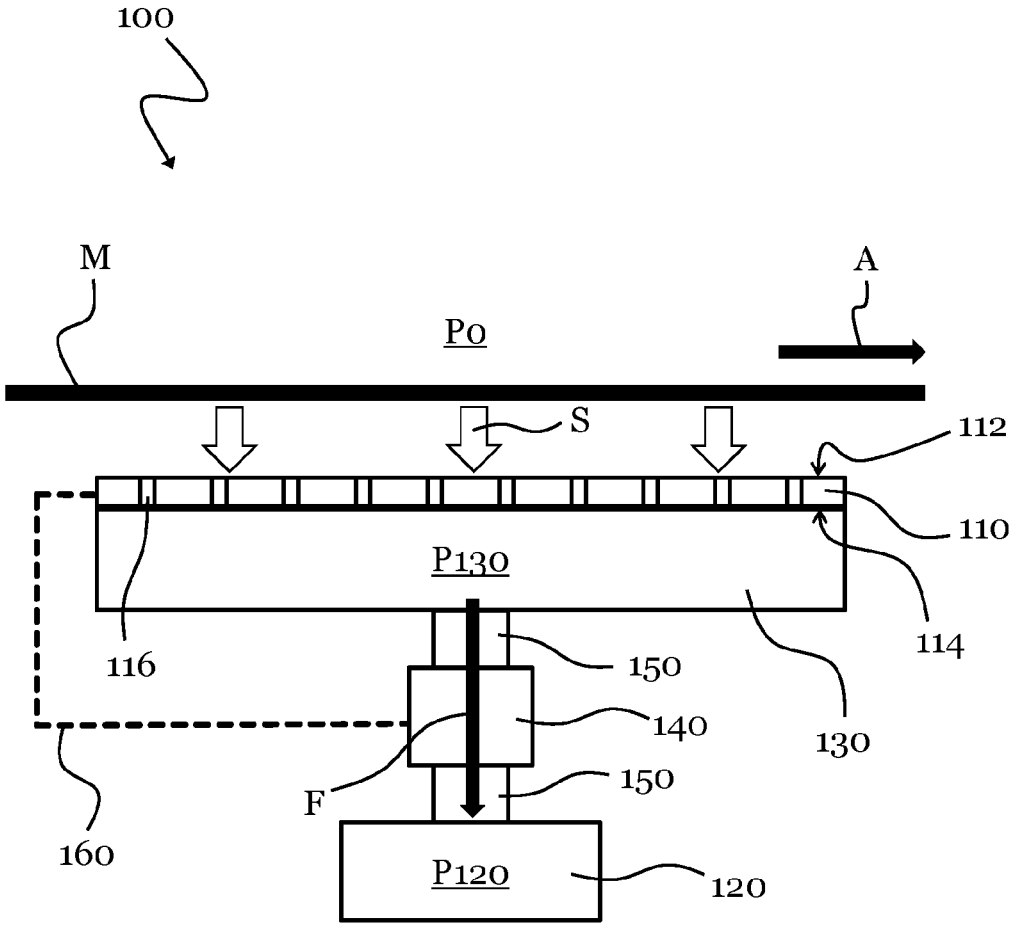
FIG. 1A shows a schematic diagram of a system to transport a medium in a sectional view along an advance direction, according to an example.

FIG. 1A shows a schematic diagram of a system 100 to transport a medium M according to an example. The system 100 comprises a medium carrier 110, a negative pressure device 120, a vacuum chamber 130, and a flow control device 140. The medium carrier no has a first side 112 and a second side 114 that are opposite to one another. The first side 112 may be an upper side and the second side 114 may be a lower side. The medium carrier no may carry the medium on the first side 112. The negative pressure device 120 may generate a negative pressure P120, which is below an ambient pressure Po. The vacuum chamber 130 is arranged at the second side 114 of the medium carrier no and is fluidly coupled to the negative pressure device 120. Fluidly coupling refers to coupling of elements to one another such as to enable a fluid flow between these elements. The flow control device 140 may be arranged between the negative pressure device 120 and the vacuum chamber 130 and may manipulate a fluid flow F from the vacuum chamber 130 towards the negative pressure device 120. The flow control device 140 is operated or operable in response to the medium carrier no changing its operational state or being in a defined operational state. For example, the fluid is air and the fluid flow F comprises a flow of air.

For example, the system 100 may transport the medium M while, before and/or after the medium M is being processed. The processing may refer to two-dimensional or three-dimensional printing. If the system 100 is related to three-dimensional printing, the medium M may comprise or be part of a print target. The medium M may comprise any material to be processed. The medium M may comprise a build material or a bed of build material for three-dimensional printing. For example, the medium M comprises a solid material. The medium M may have a surface to be processed, e.g. to be printed on. If the system 100 is related to two-dimensional printing, the medium M may be provided in form of a sheet or as a continuous web. In an example, the medium M has a surface to be printed on. For example, the medium M comprises a sheet or continuous web of paper, textile, latex, synthetic film, foil or parchment.

The first side 112 of the medium carrier no may comprise a flat or plane surface on which the medium M is to be arranged. In some examples, the medium carrier no is capable of moving in an advance direction A of the medium M to advance the medium M. The medium carrier no may be capable of conveying the medium M by means of friction. For this purpose, the first side 112 of the medium carrier no may have a sufficient friction coefficient relative to the surface of the medium M. In some examples, the medium carrier no comprises a belt or a continuous track at the first side 112 to carry and advance the medium M. In other examples, the medium M is supplied in a continuous manner, e.g. as an endless roll of material, such that the medium M may be transported between rotating rollers, without the medium carrier 110 moving in an advance direction. In this example, the medium carrier no may comprise an additional device (not depicted in FIG. 1A) for moving the medium M, such as a feed roller or a conveying roller. In an example, the system 100 is part of a printing device and the medium carrier no comprises a print platen, which, for example, may include a roller or an array of flat plates to carry the medium M through a print zone where a printing fluid is injected onto the medium M to create text or an image.

The negative pressure device 120 may be any device or structure capable of generating the negative pressure P120 below the ambient pressure Po. For example, the negative pressure device 120 comprises a vacuum pump, a blower or a fan to generate the negative pressure P120 that is below the ambient pressure Po. In an example, the ambient pressure Po is defined relative to the current pressure outside of the system 100. In another example, the ambient pressure Po is defined relative to the atmospheric pressure at the sea level at an ambient temperature of 15° C. or approx. 59 F. In some examples, the ambient pressure Po is between 800 and 1100 hPa, or between 950 and 1080 hPa, or between 970 and 1050 hPa. For example, the negative pressure P120 is by 1 to 100 hPa, or by 2 to 50 hPa, or by 10 to 10 hPa below the ambient pressure Po.

The vacuum chamber 130 may comprise a hollow volume. For example, the vacuum chamber comprises a cavity, a channel or a combination thereof. A fluid connection 150, such as a fluid channel, connects the vacuum chamber 130 and the negative pressure device 120. The pressure P130 inside the vacuum chamber 130, referred to as vacuum chamber pressure or just vacuum pressure P130, may vary between the ambient pressure Po and the negative pressure P120. In an example, the vacuum chamber 130 is also referred to as a vacuum beam.

In some examples, the vacuum chamber 130 is arranged at a bottom side of the medium carrier no wherein the medium carrier no may close a top side of the vacuum chamber 130. In some examples, the medium carrier no comprises a platen having an array of openings 116 fluidly connecting the first side 112 and the second side 114. Accordingly, the vacuum chamber 130 is in contact with the second side (bottom side) of the medium carrier no and applies a suction force S to a medium transported on the medium carrier no through the openings 116. The shape, number and positions of the openings 116 may vary.

A fluid flow is generated from the outside, or the atmosphere, through the medium carrier no towards the vacuum chamber 130 due to a pressure difference between the ambient pressure Po and the vacuum chamber pressure P130. The fluid flow may refer to an air flow. During operation of the system 100, the medium M may be arranged so as to cover at least part of the openings 116. The pressure on a top side of the medium M is the ambient pressure Po, and the pressure on a bottom side of the medium M is the vacuum chamber pressure P130 or close to the vacuum chamber pressure P130. Accordingly, the pressure on both sides of the medium M is different, and the suction force S is applied which pulls the medium M towards the medium carrier 110. The suction force S depends on the pressure difference between the ambient pressure Po and the vacuum chamber pressure P130.

The flow control device 140 may cause the fluid flow F from the vacuum chamber 130 towards the negative pressure device 120 to increase or to decrease. For example, the flow control device 140 may be operable to additionally couple a fluid reservoir to the fluid connection 150 in response to the medium carrier no changing its operational state. Furthermore, the flow control device 140 may be operable to decouple the fluid reservoir from the fluid connection 150 in response to the medium carrier no changing its operational state.

For example, the flow control device 140 may reduce a volume flow of the fluid flowing through the fluid connection 150 by coupling the fluid reservoir to the fluid connection 150 between the vacuum chamber 130 and the negative pressure device 120, thereby decreasing the fluid flow F. As a result, the vacuum chamber pressure P130 may increase, i.e. the amount of pressure difference between the ambient pressure Po and the vacuum chamber pressure P130 may decrease, which results in a reduction of the suction force S.

The flow control device 140 and the medium carrier 110 may be operatively coupled. For example, a signal line 160 for communicating signals connects the medium carrier no or an associated control device and the flow control device 140. In other examples, an electronic control circuitry may be connected to the medium carrier no and the flow control device 140 to control the operational state of the medium carrier 110 or the flow control device 140. The electronic control circuitry may control and be aware of the operating states of the medium carrier no and the flow control device 140. For example, the electronic control circuitry is implemented in an electronic device having a memory and processing power to process and generate electronic signals to control the flow control device 140.

The flow control device 140 is operated in response to the change of the operational state of the medium carrier no. Here, the expression "in response to" may include a response to a change of operational state within a certain delay of, for example, 1 to 100 ms, 1 to 50 ms or 1 to 25 ms, with respect to the change. The delay may be applied by design. The delay may be due to processing and communication of the corresponding signals between the different elements of the system 100.

Figure 1B:
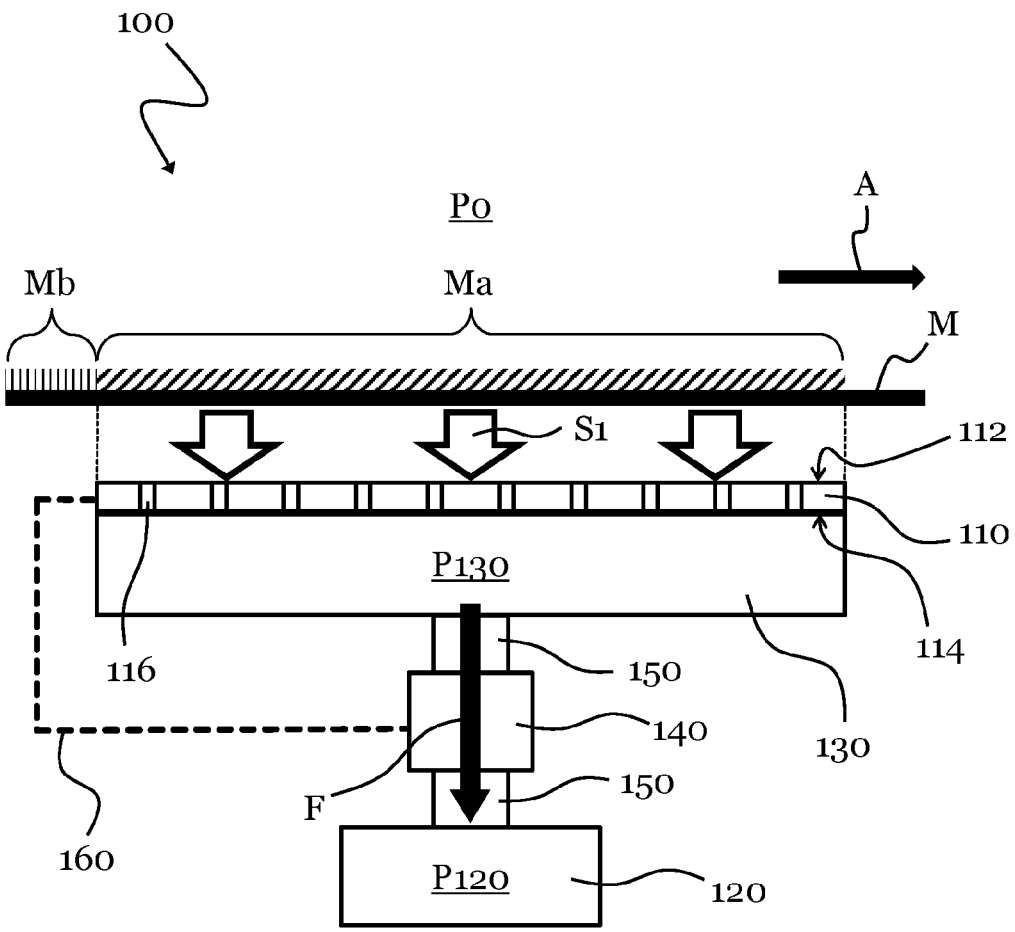
FIG. 1B-1D show schematic diagrams of the system of FIG. 1A in different operational states in a sectional view along an advance direction, according to various examples.
Figure 1C:
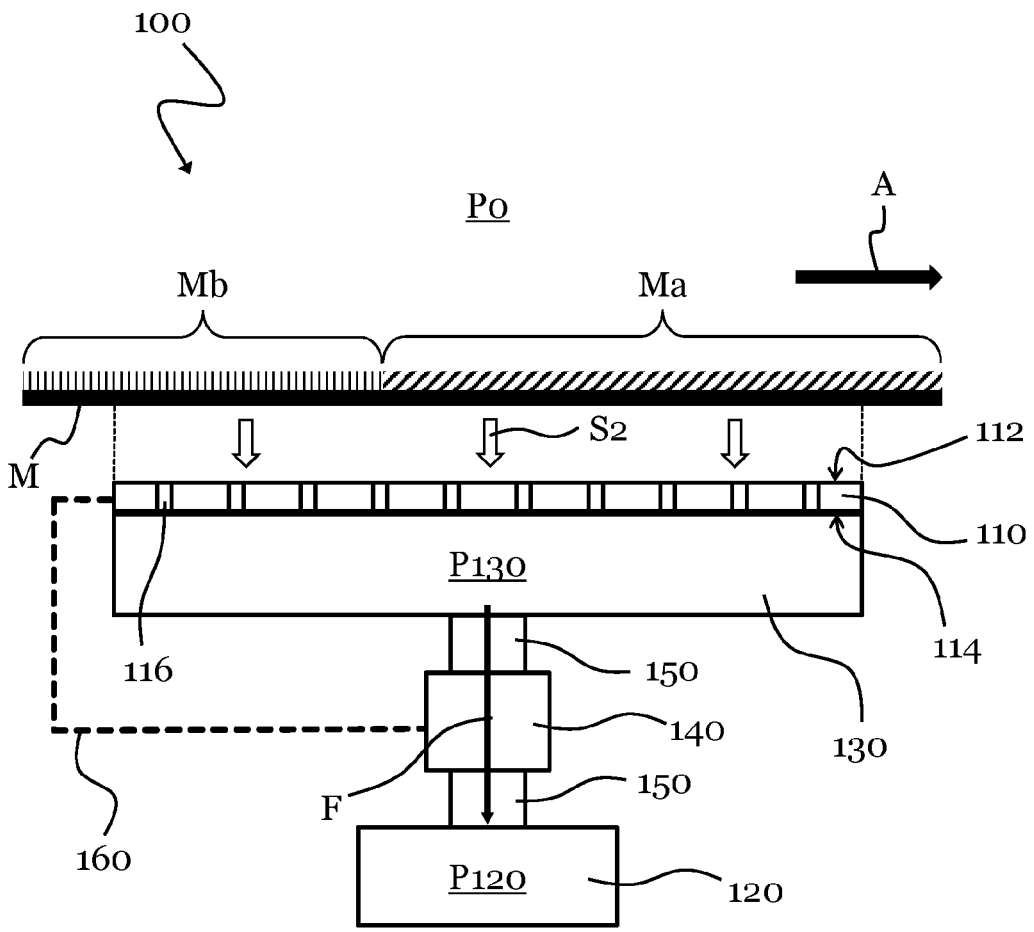
Figure 1D:
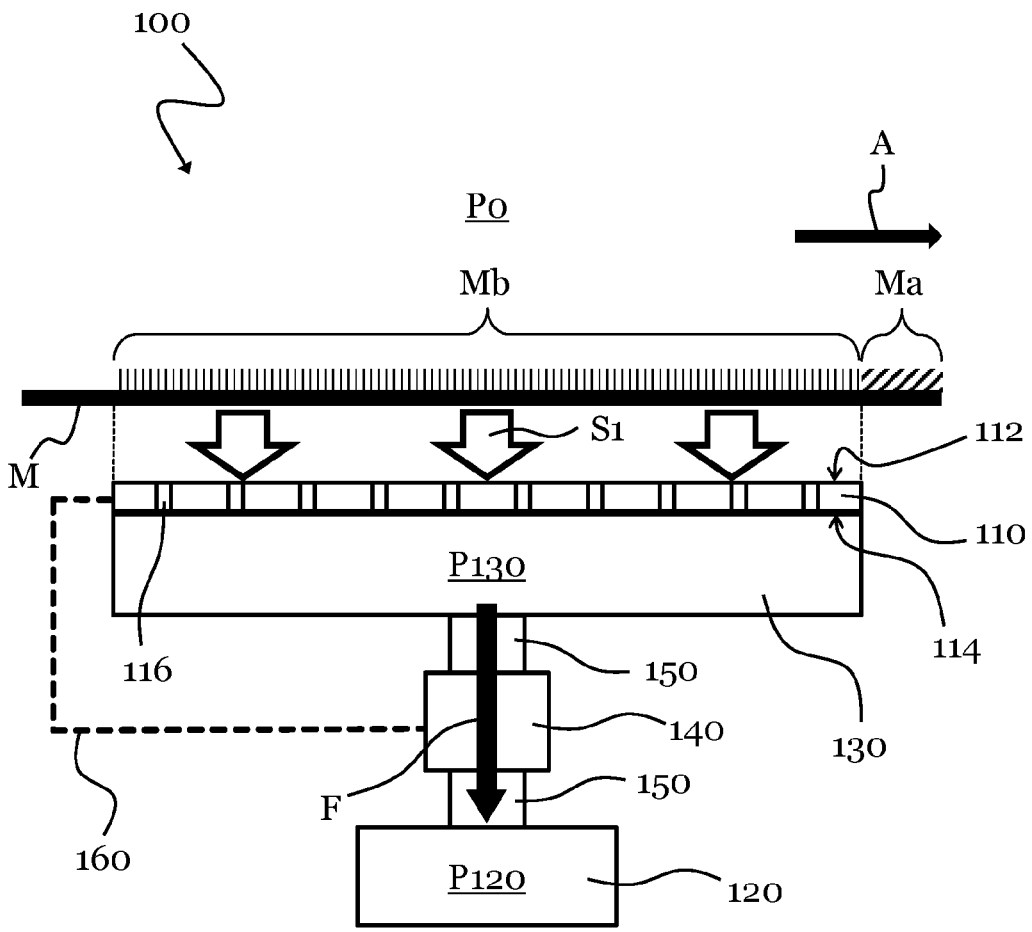

FIG. 1B to 1D show the example of FIG. 1 in different operational states. In some examples, the medium M extends beyond a processing area that can be processed in a single processing operation, in the advance direction A. The processing area may correspond to, or be less than, to a zone which is defined by the length of the medium carrier 110 in the advance direction A and by the width of the medium carrier no in a direction perpendicular thereto. Accordingly, the medium M may be repeatedly and alternately processed and advanced.

In the operational state of the system 100 as illustrated in FIG. 1B, the medium M is being held in place, i.e. it is not moving. The operational state of the medium carrier no may be related to the operational state of the system 100. The operational state of the system 100 of FIG. 1B may correspond to a processing state of the medium M. For example, printing or cutting may be performed on the medium M. Accordingly, in FIG. 1B, the operational state of the medium carrier no may correspond to a hold state. For example, the hold state refers to a state in which the medium M is stopped in a position on the first surface 112 and not moving.

When holding the medium M, e.g. for processing the medium M, the vacuum chamber pressure P130 is maintained below the ambient pressure Po such as to apply a suction force Sa. In particular, the suction force Sa is sufficiently strong to hold the medium flat on the medium carrier 110. The suction force Sa may be maintained as long as the medium M is being held.

In an example of the system 100 being part of a printing device, the medium M may arch, warp, bend or otherwise become uneven after a printing fluid has been applied. An unevenness of the surface of the medium M may result in, for example, inaccurate prints or a physical contact between the medium M and the printhead, which may impair both the printhead and the print results. Therefore, the vacuum chamber pressure P130 may be chosen so as to generate a sufficiently strong suction force S1 for holding the medium M flat and smooth on the medium carrier 110.

In FIG. 1B, a first area Ma indicates the partial area of the medium M extending across the medium carrier no, in the media advance direction A, when the medium M is being transported on the medium carrier 110. Alternatively or additionally, the first area Ma corresponds to the processed area in one single processing operation. Assuming that the system 100 is part of a printing device, the first area Ma may correspond to a printing zone of the printing device.

In FIG. 1C, the medium M is being advanced in an advance direction A. In particular, FIG. 1C illustrates an operational state of the system 100 following the operational state as shown in FIG. 1B. For example, the operational state of the system 100 or the operational state of the medium carrier no corresponds to an advance state, in which the medium M is advanced. In particular, the medium M may be advanced until the trailing end of the first area Ma has reached a boundary of the medium carrier 110 or a boundary of the processing area. Alternatively or additionally, the medium M may be advanced until an already processed portion of the medium M has left the processing area. Furthermore, the medium M may be advanced until a second area Mb of the medium M is positioned over the medium carrier 110 or the processing area.

It may be desired that the medium M is held flat and smooth on the medium carrier 110, too, when advancing in the advance direction A. However, the suction force S1 may be too strong and cause an excessive friction so that the medium M is impeded from advancing. Therefore, a suction force S2 that is below the suction force S1 may be applied to less strongly pull the medium M towards the medium carrier no while the medium M is advancing.

For this purpose, the flow control device 140 may be operated to decrease the fluid flow F from the vacuum chamber 130 towards the negative pressure device. For example, the flow control device 140 couples a fluid reservoir to the feed connection 150, from which an additional amount fluid flows towards the negative pressure device 120. If, for example, the fluid intake rate of the negative pressure device 120 is limited to a defined flow volume, coupling of an additional fluid reservoir to the fluid connection 150 results in reducing the fluid flow F from the vacuum chamber. Alternatively or additionally, the flow control device may comprise a different mechanism to decrease the flow rate F. The fluid reservoir may be an external source of the fluid or ambient atmosphere or a combination thereof.

The flow control device 140 operates in response to the medium carrier no changing its operational state. In the example shown in FIG. 1A-1D, the flow control device 140 operates to decrease the fluid flow F in response to the medium carrier no changing its operational state from a hold state to an advance state. The advance state refers to a state where the medium M is moved in the advance direction A. The advance direction A may correspond to a direction, along which the medium M is fed for processing. The medium carrier no changing its operational state may further correspond to the system 100 changing its operational state from a processing state to an advance state or vice versa. In an example where the system 100 is part of a printing device, the processing state of the system 100 may correspond to printing on the medium M, wherein the medium M is stepwise advanced in the advance direction A between each printing operations.

FIG. 1D shows the system 100 in an operational state, where the second area Mb of the medium M is positioned over the medium carrier. In this operational state, the second area Mb may be positioned in a processing area of the system 100. Accordingly, the medium carrier 110 is in a hold state to hold the medium M. The flow control device 140 operates to increase the fluid flow F from the vacuum chamber 130 towards the negative pressure device 120 in response to the medium carrier no changing its operational state from the advance state to the hold state. For example, the flow control device 140 decouples a fluid reservoir from the fluid connection 150 to increase the fluid flow F. For example, decoupling the fluid reservoir from the fluid connection 150 may leave the vacuum chamber 130 as the remaining fluid source from which the negative pressure device 120 can suck in the fluid. Alternatively or additionally, the flow control device 140 may comprise a different mechanism to increase the fluid flow F.

Accordingly, the vacuum chamber pressure P130 is decreased, and the suction force S is increased from S2 to S1. The operational states shown in FIG. 1A-1D may be performed alternately and repeatedly until the processing on the medium M is finished. For example, the operational states are repeated until the printing of a desired image or text on the medium M has been completed. Using the flow control device 140, the system 100 allows for a quick change of the vacuum chamber pressure P130, and thus for a quick adjustment of the suction force S. Here, the quick change or quick adjustment may refer to a change or adjustment within 0, 1 to 100 milliseconds, or 0, 1 to 50 milliseconds, or 0, 1 to 25 milliseconds.

In summary, the flow control device 140 may manipulate the fluid flow F from the vacuum chamber 130 towards the negative pressure device 120 such as to reduce the fluid flow F when the medium M is advancing, and to increase the fluid flow F when the medium F is being held. The suction force S that pulls the medium M towards the medium carrier 110 increases with increasing fluid flow F. Accordingly, the suction force S is reduced when the medium M is advancing, and increased when the medium M is being held. The system 100 hence allows for the adhesion strength of the medium M to the medium carrier no to be varied depending on the operational state of the medium carrier 110.

In an example, the system 100 is a printing device for printing on the surface of the medium M. The medium M may be a print medium, for example paper, cardboard, textile, or a synthetic sheet. The system 100 may further comprise a fluid ejection device to eject a printing fluid onto the medium M. The flow control device may be operated in response to the medium carrier 110 or the fluid ejection device changing their respective operational state. For example, the operational state of the fluid ejection device may comprise a run-and-eject state, where the fluid ejection device moves over the medium M and ejects the printing fluid onto it, and a steady state, where the fluid ejection device stays put without ejecting the printing fluid. The steady state of the fluid ejection device may correspond to, or performed in response to, the hold state of the medium carrier 110. The run-and-eject state of the fluid ejection device may correspond to, or performed in response to, the advance state of the medium carrier 110.

In some examples, the flow control device 140 can set the vacuum chamber pressure P130 to 100 to 2000 Pa, or 200 to 1500 Pa, or 500 to 900 Pa, below the ambient pressure Po, when the operational state of the medium carrier no changes to the hold state. In some examples, the flow control device 140 is to set the vacuum chamber pressure P130 to 10 to 100 Pa, 20 to 200 Pa, or 50 to 500 Pa below the ambient pressure Po, when the operational state of the medium carrier no changes to the advance state.

Figure 2:
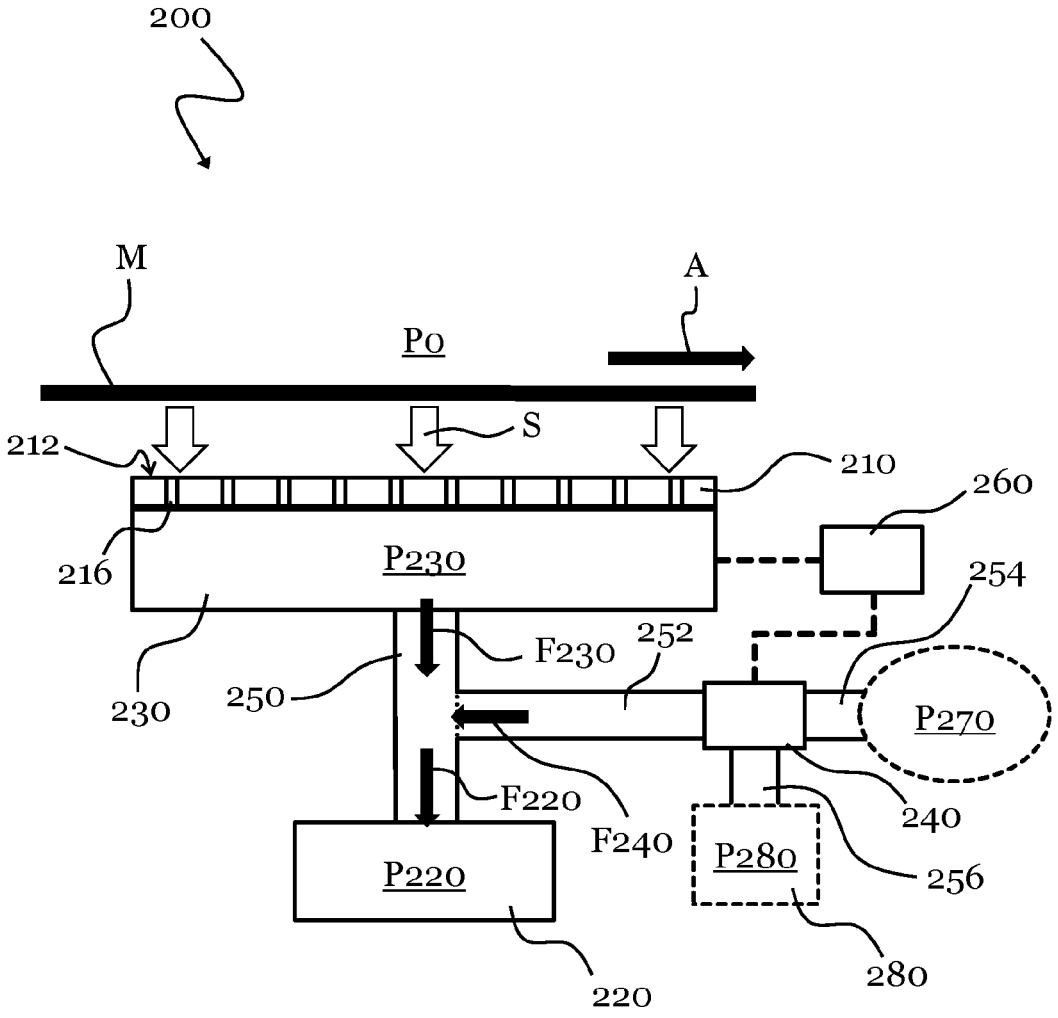
FIG. 2 shows a schematic diagram of a system to transport a medium in a sectional view along an advance direction, according to an example.

FIG. 2 shows a schematic view of a system 200 to transport a medium M according to further example. The system 200 comprises a medium carrier 210, a negative pressure device 220, a vacuum chamber 230 and a flow control device 240. The medium carrier 210 has a first side 212 and a second side 214 that are opposite to one another. The medium carrier 210 may carry the medium M on the first side 212. The negative pressure device 220 may generate a negative pressure P220, which is below an ambient pressure Po. The vacuum chamber 230 is arranged at the second side 214 of the medium carrier 210 and is fluidly coupled to the negative pressure device 220. The flow control device 240, the negative pressure device 220 and the vacuum chamber 230 may be fluidly connected to one another. The flow control device 240 may manipulate a fluid flow F from the vacuum chamber 230 towards the negative pressure device 220. The flow control device 240 is operated or operable in response to the medium carrier 210 changing its operational state or being in a defined operational state. For example, the fluid refers to air and the fluid flow F refers to the flow of air.

The features described with respect to FIG. 2 and their functionality may at least in part correspond to respective features of the example described with reference to FIG. 1A to 1D. As far as the same or corresponding features are concerned, reference is made to the above description of FIG. 1A to 1D. In general, any features described with respect to one of the examples may also be used in other examples in any combination thereof wherein, for the sake of conciseness, the description of all of the details of features is not repeated for each of the examples.

The system 200 may further comprise a control unit 260 to control the medium carrier 210 or the flow control device 240. In particular, the control unit 260 may operate the flow control device 240 in response to the medium carrier 210 changing its operational state. The control unit 260 may comprise a control circuitry to generate, send or receive an electrical signal that is related to controlling the medium carrier 210.

The system 200 comprises a feed channel 250 fluidly coupling the negative pressure device 220 and the vacuum chamber 230. The feed channel 250 may comprise a fluid conduit, such as a pipe line or a tube. The feed channel 250 may fluidly connect the negative pressure device 220 and the vacuum chamber 230 in an air-tight manner. The feed channel 250 may comprise an interface 252 fluidly coupled to the flow control device 240. The interface 252 may be an opening, a junction, or a connection formed at the feed channel 250 for fluidly coupling the flow control device 240 to the feed channel 250.

The feed channel 250 may comprise a first end connected to the negative pressure device 220 and a second end connected to the vacuum chamber 230. At the least one of the first end and the second and may comprise a flange to fix the feed channel 250 to the negative pressure device 220 and the vacuum chamber 230, respectively. In an example, the negative pressure device 220 may have one single fluid inlet port. The vacuum chamber 230 may have one single fluid outlet port. The feed channel 250 may connect the fluid inlet port of the negative pressure device 220 and the fluid outlet port of the vacuum chamber 230 to one another.

For example, the interface 252 may be an opening formed at the feed channel 250. Additionally or alternatively, the interface 252 may comprise a branch channel, branching off from the feed channel 250 formed between the junctions with the negative pressure device 220 and the vacuum chamber 230. In an example, the feed channel 250 including the interface 252 provides a three-way pipe coupling connecting the negative pressure device 220, the vacuum chamber 230 and the flow control device 240.

The flow control device 240 is connected to a fluid reservoir 270. The pressure inside the fluid reservoir 270 is referred to as a reservoir pressure P270. The reservoir pressure P270 may be equal to the ambient pressure Po. For example, the fluid reservoir 270 is open to ambient atmosphere. Additionally or alternatively, the fluid reservoir 270 comprises a reservoir chamber, wherein the reservoir pressure P270 is between the ambient pressure Po and the negative pressure P220. In some examples, the reservoir pressure is 0 to 1000 Pa, or 0 to 500 Pa, or 0 to 300 Pa below the ambient pressure Po.

The flow control device 240 is operated in response to the medium carrier 210 changing its operational state, e.g. between a hold state and an advance state as described above. When being operated, the flow control device 240 may fluidly couple the fluid reservoir 270 to the feed channel or decouple the fluid reservoir 270 from the feed channel 250.

For example, the flow control device 240 comprises a valve for opening and closing the fluid connection between the feed channel 250 and the fluid reservoir 270. The flow control device 240 may be operated so as to change between at least two distinct operational states. The operational states of the flow control device 240 may include at least an open state and a closed state corresponding to coupling the fluid reservoir 270 to the feed channel 250 and decoupling the fluid reservoir 270 from the feed channel 250, respectively. In some examples, the flow control device 240 further comprises at least an intermediate operational state between open and closed states, such as an X % opened state, with X being any number between 0 and 100, such as 25, 50, and 75.

For example, the flow control device 240 is operated to change its operational state within 1 to 100 ms, or 1 to 50 ms, or 1 to 20 ms. Accordingly, the flow control device 240 allows for a quick adjustment of a fluid flow F from the vacuum chamber 230 towards the negative pressure device 220 and thus a quick adjustment of the suction force S in the above described manner.

For example, if the flow control device 240 is operated such as to decouple the fluid reservoir 270 from the fluid channel 250, a fluid flow F230 flowing from the vacuum chamber 230 towards the negative pressure device 220 equals or is close to a fluid flow P220 that can be generated by the negative pressure device 220. If the flow control device 240 is operated such as to couple the fluid reservoir 270 to the fluid channel 250, an additional fluid flow F240 from the fluid reservoir 270 towards the negative pressure device 220 is generated due to the difference between the reservoir pressure P270 and the negative pressure P220. Assuming that the fluid flow 220 that can be generated by the negative pressure device 220 is limited, the generation of the additional fluid flow F240 results in a reduction of the fluid flow F230 from the vacuum chamber 230. As the fluid flow F230 decreases, the suction force S is reduced as a result.

In some examples, the flow control device 240 is in addition connected to a second fluid reservoir 280 having a second reservoir pressure P280. In this example, the fluid reservoir 270 may be referred to a first fluid reservoir 270. The first fluid reservoir 270 and the second fluid reservoir 280 may be connected or separate. The second reservoir pressure P280 may be different from the reservoir pressure P270. In some examples, the second reservoir pressure P280 may be between the ambient pressure Po and the negative pressure P220. The second reservoir pressure P280 may be equal to the ambient pressure Po, wherein the reservoir pressure P270 is below the ambient pressure Po, or vice versa.

The flow control device 240 may be operable to couple one, both or none of the first fluid reservoir 270 and the second fluid reservoir 280. Accordingly, the flow control device 240 may be operated to fluidly couple either one of the first fluid reservoir 270 and the second fluid reservoir 280 to the feed channel 250, while decoupling the other one of the reservoirs 270, 280 from the feed channel 250. Alternatively or additionally, the flow control device 240 may be operated to fluidly couple both of the fluid reservoirs 270, 280 to the feed channel and to decouple them from the feed channel 250.

In some examples, the suction force S is the strongest when both of the fluid reservoirs 270, 280 are decoupled from the feed channel 250. The suction force S may be reduced by coupling one of the fluid reservoirs 270, 280 to the feed channel 250. The suction force S may be further reduced by coupling both of the fluid reservoirs 270, 280 to the feed channel 250. Accordingly, the suction force S may be variable between more than two distinct values. The flow control device 240 may be coupled to a further fluid reservoir to provide further intermediate operational states. Additionally or alternatively, the suction force S may be varied by controlling the opening degree of the flow control device 240.

Figure 3:
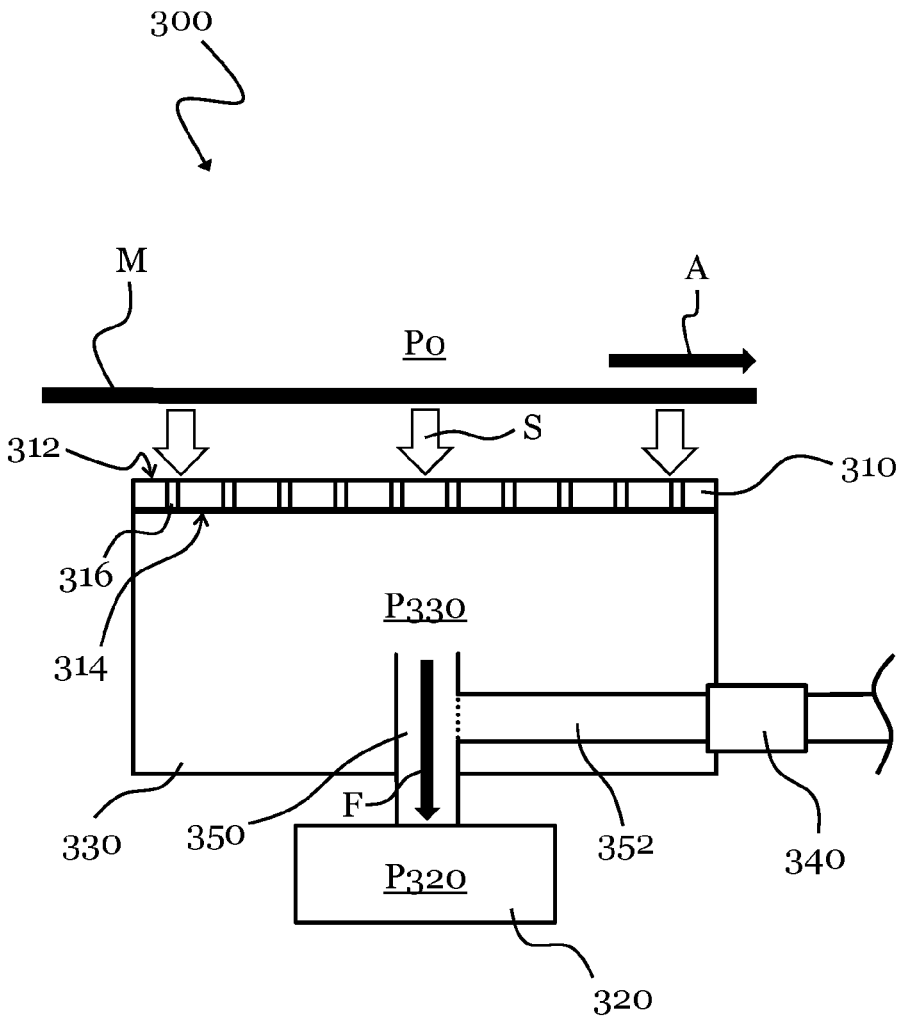
FIG. 3 shows a schematic diagram of a system to transport a medium in a sectional view along an advance direction, according to an example.

FIG. 3 shows a schematic view of a system 300 to transport the medium M according to a further example. The system 300 comprises a medium carrier 310, a negative pressure device 320, a vacuum chamber 330 and a flow control device 340. The medium carrier 310 has a first side 312 and a second side 314 that are opposite to one another. The medium carrier 310 may carry the medium M on the first side 312. The negative pressure device 320 may generate a negative pressure P320, which is below an ambient pressure Po. The vacuum chamber 330 is arranged at the second side 314 of the medium carrier 310 and is fluidly coupled to the negative pressure device 320. The flow control device 340, the negative pressure device 320 and the vacuum chamber 330 may be fluidly coupled to one another. The flow control device 340 may manipulate a fluid flow F from the vacuum chamber 330 towards the negative pressure device 320. The flow control device 340 is operated or operable in response to the medium carrier 310 changing its operational state or being in a defined operational state. The features of the system 300 and their functionality may at least partially correspond to those of the systems 100 or 200 as described above. The features described with respect to FIG. 3 and their functionality may at least in part correspond to respective features of the example described with reference to FIG. 1A to 1D or FIG. 2. As far as the same or corresponding features are concerned, reference is made to the above description.

The system 300 comprises a feed channel 350 that is partially located inside the vacuum chamber 330. The feed channel comprises an interface 352 fluidly coupled to the flow control device 340. In an alternative example not shown in FIG. 3, the feed channel 350 may be located completely inside the vacuum chamber 330. In FIG. 3, part of the feed channel 350 is located outside of the vacuum chamber 330. Accommodating the feed channel 350 at least partially inside the vacuum chamber 330 may result in saving space within the system 300. With regard to the connectivity of the different components and their functionality, reference is made to the description of FIGS. 1 and 2 above. For example, the flow control device 340 may be coupled to a fluid reservoir as described referring to FIG. 2, and may be operable to couple or decouple the fluid reservoir in response to the medium carrier 410 changing its operational state in the above described manner.

Figure 4:
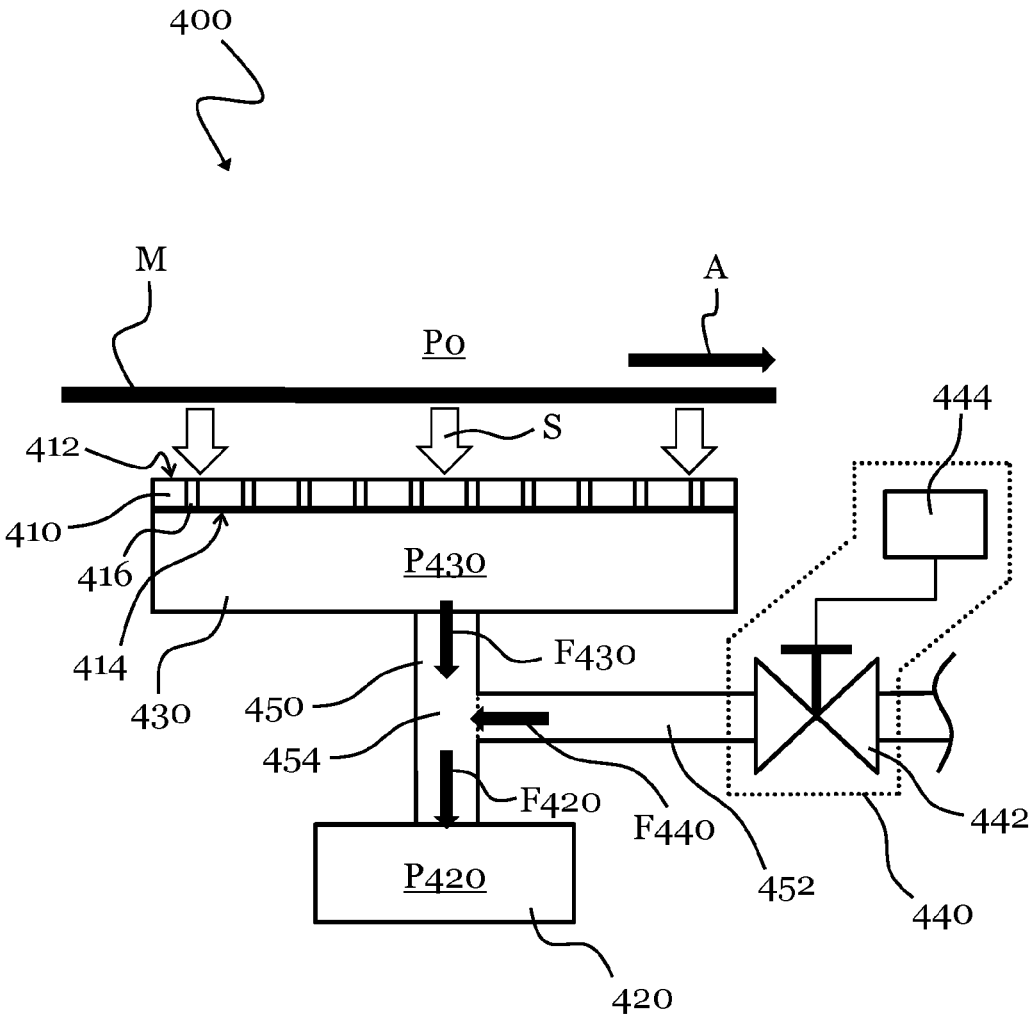
FIG. 4 shows a schematic diagram of a system to transport a medium in a sectional view along an advance direction, according to an example.

FIG. 4 shows a schematic partial view of a system 400 to transport the medium M according to another example. The system 400 comprises a medium carrier 410, a negative pressure device 420, a vacuum chamber 430, a flow control device 440. The medium carrier 410 has a first side 412 and a second side 414 that are opposite to one another. The medium carrier 410 may carry the medium M on the first side 412. The negative pressure device 420 may generate a negative pressure P420, which is below an ambient pressure Po. The vacuum chamber 430 is arranged at the second side 414 of the medium carrier 410 and is fluidly coupled to the negative pressure device 420 via a fluid channel 450. The flow control device 440, the negative pressure device 420 and the vacuum chamber 430 may be fluidly coupled to one another. The flow control device 440 may manipulate a fluid flow F from the vacuum chamber 430 towards the negative pressure device 420. The flow control device 440 is operated or operable in response to the medium carrier 410 changing its operational state or being in a defined operational state. The features described with respect to FIG. 4 and their functionality may at least in part correspond to respective features of the example described with reference to FIG. 1A to 1D, 2 or 3. As far as the same or corresponding features are concerned, reference is made to the above description.

The fluid channel 450 fluidly couples the vacuum chamber 430 and the negative pressure device 420 to one another. The fluid channel 450 comprises an interface 452, for example a branch channel 452, fluidly coupled to the flow control device 440. The flow control device 440 comprises a valve 442 to operate. In addition, the flow control device 440 may comprise an actuator 444 or a handle (not shown) to control the valve 442. For example, the flow control device includes a gate valve, a ball valve, a globe valve or a butterfly valve.

In various examples, the valve 442 may comprise a valve member, e.g. a disk, (not shown) as a movable obstruction inside a stationary body that adjustably restricts flow through the valve 442. Depending on the type of valve, the valve member may movable linearly inside the body of the valve 442, or rotatable on a stem, a hinge or a trunnion.

In case of a ball valve, the valve member comprises a ball with a path between ports passing through the ball. By rotating the ball, flow can be directed between different ports. The ball valve may use spherical rotors with a cylindrical hole drilled as a fluid passage. In various examples, the ball valve may be a quarter-turn valve which uses a hollow, perforated and pivoting ball to control flow through it. For example, the ball valve is open when the hole of the ball is aligned with the branch channel 452 and a respective fluid path defined by the branch channel 452 and closed when it is pivoted 90-degrees. Pivoting can be effected by the actuator 444 or a valve handle.

A gate valve may be operated by moving a gate element out of and into the fluid path. In various examples, a valve seat having planar sealing surfaces to engage with the gate element may be provided in the gate valve. The gate element faces may be parallel or wedge-shaped. The gate valve also may be referred to as a sluice valve.

A globe valve comprises a movable valve member, e.g. a plug or a disk, and a stationary ring seat in a generally spherical body. The body of the globe valve may be separated by an internal baffle with an opening that forms the seat onto which the valve member can be slid or screwed down to throttle the fluid flow.

In a butterfly valve, a disk is used as the valve member and is positioned in the middle of the fluid connection. A rod passes through the disk to the actuator 444 on the outside of the valve 442. Rotating the actuator 444 turns the disk either parallel or perpendicular to the flow.

The actuator 444 may include a device to automatically or remotely control the valve 442 from outside the body of the valve 442. The actuator 442 may allow for a quick operation of the flow control device 440. The actuator 442 may comprise a mechanical actuator, a hydraulic actuator, or a solenoid actuator. For example, the actuator 442 may be an electrically driven solenoid actuator capable of opening and closing the valve 442 within 1 to 100 ms, or 1 to 50 ms or 1 to 25 ms.

Figure 5:
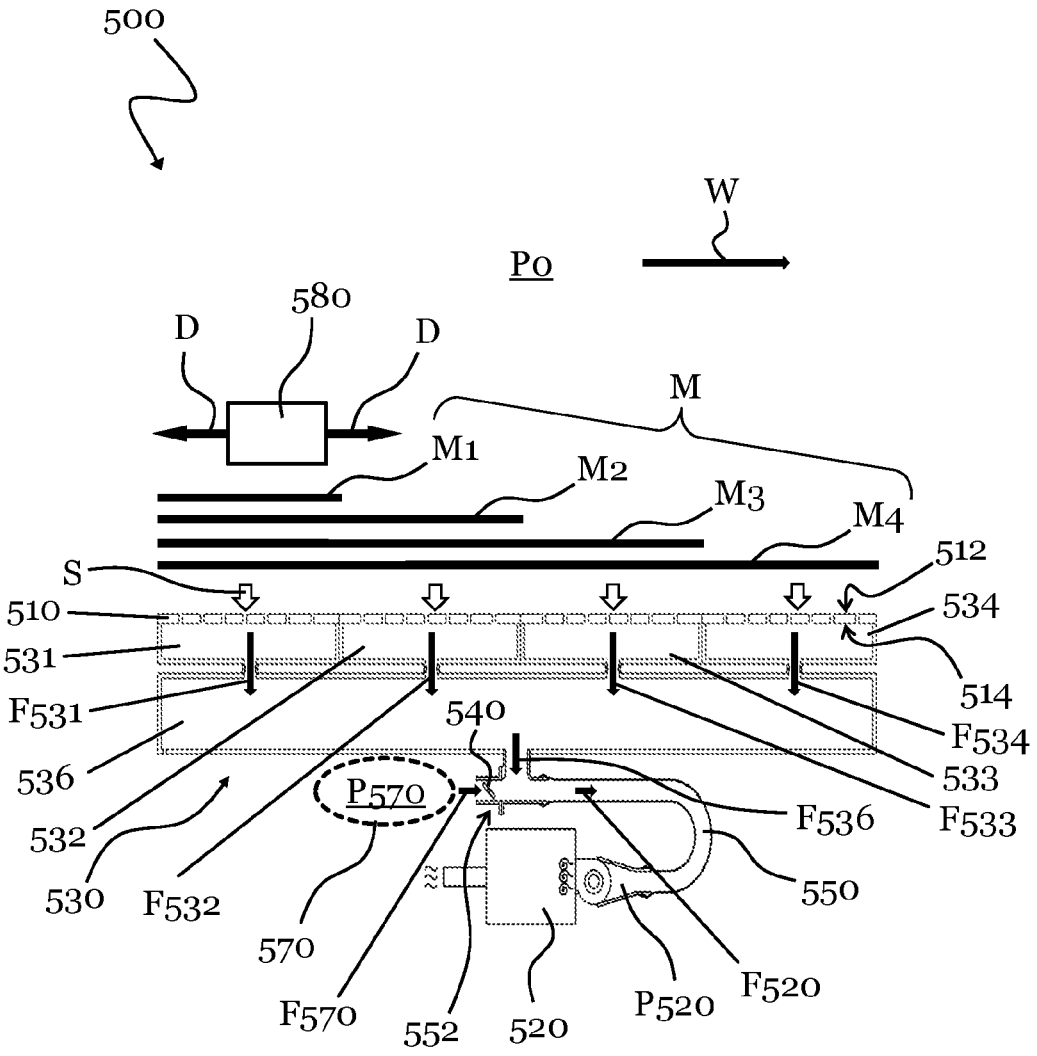
FIG. 5 shows a schematic diagram of a system to transport a medium in a sectional view transverse to an advance direction, according to an example.

FIG. 5 shows a schematic view of a system 500 to transport the medium M, which may have different sizes as schematically depicted by reference numbers M1, M2, M3 and M4, according to a further example. The system 500 comprises a medium carrier 510, a negative pressure device 520, a vacuum chamber 530 and a flow control device 540 coupled via a fluid channel 550. The medium carrier 510 has a first side 512 and a second side 514 that are opposite to one another. The medium carrier 510 may carry the medium M on the first side 512. The negative pressure device 520 may generate a negative pressure P520, which is below an ambient pressure Po. The vacuum chamber 530 is arranged at the second side 514 of the medium carrier 510 and is fluidly coupled to the negative pressure device 520. The flow control device 540, the negative pressure device 520 and the vacuum chamber 530 may be fluidly coupled to one another and the flow control device 540 may manipulate a fluid flow F536 from the vacuum chamber 530 towards the negative pressure device 520. The flow control device 540 is operated or operable in response to the medium carrier 510 changing its operational state or being in a defined operational state. The features described with respect to FIG. 5 and their functionality may at least in part correspond to respective features of the example described with reference to FIG. 1A to 1D, 2, 3 or 4. As far as the same or corresponding features are concerned, reference is made to the above description.

In the example of FIG. 5, the vacuum chamber 530 is divided into a plurality of top chambers 531, 532, 533, 534 and a bottom chamber 536. In various examples, each of the top chambers 531, 532, 533, 534 is dimensioned to match predefined different widths of the medium M, which may be typical medium width according to different standards, such as DIN A4, DIN A3, and US Letter. For example, the medium M may be provided according to the ISO A paper series. Beginning with the smallest paper width, different numbers or different sets of adjacent top chambers 531, 532, 533, 534 may be used for processing the medium M. In some examples, the medium carrier 510 may have a customized dimension in the width direction. For example, the width of the medium carrier 510 may be 0, 1 to 10 meters, or 0, 1 to 5 meters, or 0, 1 to 2 meters. The system 500 may be capable of processing the medium M, e.g. printing on the medium M, that has the same width as, or a smaller width than the width of the medium carrier 510. In some examples, the medium M may be up to 64 inches wide.

The system 500 further comprises the fluid channel 550 fluidly coupling the vacuum chamber 530 to the negative pressure device 520. The fluid channel 550 comprises an interface 552, for example a branch channel fluidly coupled to the flow control device 540. The flow control device is fluidly connected to a fluid reservoir 570 at a reservoir pressure P570 that is above the negative pressure P520. The flow control device 540 is operable to couple the fluid reservoir 570 to the feed channel 550 or decouple the fluid reservoir 570 from the feed channel 550 in response to the medium carrier 510 changing its operational state.

The functional principles of the flow control device 540 manipulating the fluid flow F536 may be as described above. For example, when the flow control device 540 decouples the fluid reservoir 570 from the feed channel 550, the fluid flow F536 may be equal or close to the fluid flow F520 generated by the negative pressure device 520. When the flow control device couples the fluid reservoir 570 to the feed channel 550, an additional fluid flow F570 from the fluid reservoir 570 to the feed channel 550 may be generated due to the difference between the reservoir pressure P570 and the negative pressure P520. Assuming that the fluid flow F520 is limited, the fluid flow F570 may cause the fluid flow F536 from the vacuum chamber 536 to decrease.

For example, the medium M1, M2, M3 and M4 is standardized paper sheet according to ISO A4, A3, A2 and A1, respectively. In other examples, the width of the medium M4 may be 64 inches. Accordingly, the width of the medium M3, M2 and M1 may be 48 inches, 32 inches and 16 inches, respectively. In other examples, the width of the medium carrier 510 in total or any of the individual widths of the top chambers 531, 532, 533, 534 may be customized. For processing the medium M1, the top chamber 531 may be fluidly coupled to the bottom chamber 536, while the top chambers 532, 533 and 534 are decoupled from the bottom chamber 536. For processing the medium M2, the top chambers 531 and 532 may be fluidly coupled to the bottom chamber 536, while the top chambers 533 and 534 are decoupled from the bottom chamber 536. For processing the medium M3, the top chambers 531, 532 and 533 may be fluidly coupled to the bottom chamber 536, while the top chamber 534 is decoupled from the bottom chamber 536. Fluidly coupling any of the top chambers 531, 532, 533, 534 to the bottom chamber 536 allows for a respective fluid flow F531, F532, F533, F534 from the respective top chamber 531, 532, 533, 534 to the bottom chamber 536. In some examples, at least two of the top chambers 531, 532, 533, 534 may have different widths.

Accordingly, the vacuum chamber 530 is divided into at least two subchambers 532 in a width direction W of the medium M. The width direction W may be perpendicular to the advance direction A as described above. The respective pressure in the subchambers may be separately controllable. For this purpose, the subchambers, corresponding to the top chambers 531, 532, 533 and 534 in the example of FIG. 5, may be individually coupled to the bottom chamber 536 and decoupled from it. As a result, the suction force S can be limited generated over a limited set of the subchambers according to the width of the medium M.

In some examples, the system 500 may be part of a printing device. The medium M may correspond to a print medium, e.g. paper, textile, synthetic material, cardboard, etc. The system 500 may comprise a fluid ejection device 580 to eject a printing fluid onto the medium M. The flow control device 540 may be operable in response to the medium carrier 510 or the fluid ejection device 580 changing their respective operational state.

For example, the fluid ejection device 580 may comprise a carriage carrying a printhead or an array of printheads (not shown) for ejecting the printing fluid onto the medium M. When the printing device or the system 500 is in a printing state, the carriage device 580 may scan over the medium M along the width direction W while ejecting the printing fluid according to a target image or text, therefore being in a scan-and-eject state. For example, the medium carrier 510 may be in a hold state while the carriage device 580 is in the scan-and-eject state. The flow control device 540 may decouple the fluid reservoir 570 from the feed channel 550 in response to the medium carrier 510 being in the hold state or the carriage device 580 being in the scan-and-eject state to increase the fluid flow from the vacuum chamber.

When the printing device or the system 500 advances the medium M to print a next area on the medium, the carriage 580 may stop moving or return to a default position, therefore being in a default or idle state. For example, the medium carrier 510 may be in an advance state while the carriage device 580 is in the default state. The flow control device 540 may couple the fluid reservoir 570 to the feed channel 550 in response to the medium carrier 510 being in the advance state or the carriage device 580 being in the default state to decrease the fluid flow from the vacuum chamber.

Any of the medium carriers described above in connection with FIGS. 1A-1D and 2-5 may comprise an operational state other than the advance state and hold state as described above. The fluid ejection device may comprise an operational state other than the scan-and-eject state and the default state as described above. For example, the operational state of the fluid ejection device may further comprise an idle state, a service state, a powering down state, or a combination thereof. The flow control device 540 may manipulate the fluid flow F536 according to the further operational state.

Figure 6:
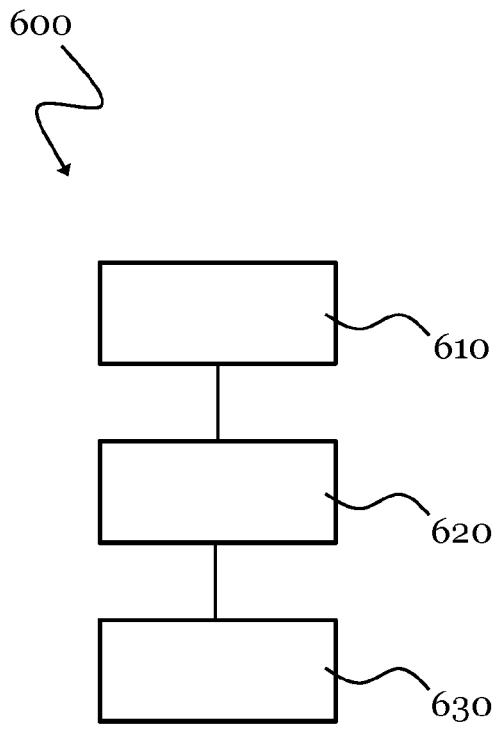
FIG. 6 shows a flow diagram of a process of transporting a medium, according to an example.

FIG. 6 shows a flow diagram of a process 600 to transport a medium. At 602, the medium is carried on a first side of a medium carrier. At 604, a vacuum pressure below an ambient pressure is applied on a second side of the medium carrier opposite to the first side thereof. At 606, the vacuum pressure is varied in response to the medium carrier changing its operational state. The process 600 may be performed using any of the above described systems 100 to 500.

In some examples, a vacuum chamber is disposed on the second side of the medium carrier, and a negative pressure device is fluidly coupled to the vacuum chamber. The process may further comprise applying the vacuum pressure using the negative pressure device via a feed channel. In this example, a fluid reservoir may be fluidly coupled to the feed channel to decrease a suction force on the medium towards the medium carrier. The fluid reservoir may be decoupled from the feed channel to increase the suction force.

In some examples, the process further comprises printing on the medium, while the medium carrier holds the medium and the vacuum pressure is at a first pressure. The process may further comprise advancing the medium in an advance direction, while the vacuum pressure is at a second pressure that is between the first pressure and the ambient pressure.

In some examples, the operational states of the medium carrier include at least an advance state and a hold state. For example, the process further comprises setting the vacuum pressure to 500-900 Pa below the ambient pressure, when the operational state of the medium carrier changes to the hold state. Furthermore, the process may further comprise setting the vacuum pressure to 50-500 Pa below the ambient pressure, when the operational state of the medium carrier changes to the advance state.

The invention claimed is:

1. A system to transport a medium, comprising:

a medium carrier to carry the medium on a first side of the medium carrier;

a negative pressure device to generate a negative pressure, wherein the negative pressure is below an ambient pressure;

a vacuum chamber disposed on a second side of the medium carrier opposite to the first side and fluidly coupled to the negative pressure device;

a flow control device to manipulate a fluid flow from the vacuum chamber towards the negative pressure device, wherein the flow control device is operated in response to the medium carrier changing its operational state; and a feed channel fluidly coupling the vacuum chamber and the negative pressure device to one another, wherein the feed channel comprises an interface fluidly coupled to the flow control device, and the flow control device is to additionally couple a fluid reservoir to the feed channel in response to the medium carrier changing its operational state.

2. The system of claim 1, wherein:

the flow control device is further to decouple the fluid reservoir from the feed channel in response to the medium carrier changing its operational state.

3. The system of claim 1, wherein:

the fluid reservoir includes a reservoir chamber.

4. The system of claim 1, wherein:

the flow control device includes a valve that is a gate valve, a ball valve, a globe valve, or a butterfly valve.

5. The system of claim 1, wherein:

the flow control device comprises an actuator that is a mechanical actuator, a hydraulic actuator, or a solenoid actuator.

6. The system of claim 1, wherein:

the flow control device comprises an actuator that is a mechanical actuator, a hydraulic actuator, or a solenoid actuator.

7. The system of claim 1, wherein:

the vacuum chamber is divided into at least two subchambers in a width direction of the medium; and wherein respective pressure in the subchambers is separately controllable.

8. A printing device, comprising:

a medium carrier to carry a print medium on a first side of the medium carrier;

a negative pressure device to generate a negative pressure, wherein the negative pressure is below an ambient pressure;

a vacuum chamber disposed on a second side of the medium carrier opposite to the first side and fluidly coupled to the negative pressure device;

a flow control device to manipulate a volume flow from the vacuum chamber towards the negative pressure device;

a fluid ejection device to eject a printing fluid onto the print medium, wherein the flow control device is operated in response to a change of operational state of the medium carrier or the fluid ejection device; and a feed channel fluidly coupling the vacuum chamber and the negative pressure device to one another, wherein the feed channel comprises an interface fluidly coupled to the flow control device, and the flow control device is to additionally couple a fluid reservoir to the feed channel in response to the medium carrier changing its operational state.

9. A method to transport a medium, comprising:

carrying the medium on a first side of a medium carrier;

applying a vacuum pressure below an ambient pressure on a second side of the medium carrier opposite to the first side thereof;

varying the vacuum pressure in response to the medium carrier changing its operational state;

applying the vacuum pressure using a negative pressure device fluidly coupled to a chamber on the second side of the medium carrier via a feed channel;

fluidly coupling a fluid reservoir to the feed channel to decrease a suction force on the print medium towards the medium carrier; and decoupling the fluid reservoir from the feed channel to increase the suction force.

10. The method of claim 9, further comprising:

printing on the printing medium, while the print medium carrier holds the print medium and the vacuum pressure is at a first pressure;

advancing the printing medium in an advance direction, while the vacuum pressure is at a second pressure that is between the first pressure and the ambient pressure.

11. The method of claim 9, wherein:

the operational state of the medium carrier includes an advance state and a hold state.

12. The system of claim 11, further comprising:

setting the vacuum pressure to 500-900 Pa below the ambient pressure, when the operational state of the medium carrier changes to the hold state; and setting the vacuum pressure to 50-500 Pa below the ambient pressure, when the operational state of the medium carrier changes to the advance state.

* * * * *